United States Patent [19]

Pond

[11] Patent Number: 4,501,457

[45] Date of Patent: Feb. 26, 1985

[54] KITCHEN TABLE FOR CAMPER

[76] Inventor: Murray C. Pond, 294 Scottsdale Dr., Guelph, Ontario, Canada, N1G 2K8

[21] Appl. No.: 450,671

[22] Filed: Dec. 17, 1982

[51] Int. Cl.[3] ..... A47B 77/10; A47B 37/04

[52] U.S. Cl. ..... 312/314; 108/44; 108/48; 224/42.43; 296/22; 312/317 R

[58] Field of Search ..... 108/44, 48, 47, 60; 206/523, 524; 312/314, 317; 296/22; 224/42.46 R, 42.43, 42.44, 42.45 R

[56] References Cited

U.S. PATENT DOCUMENTS

| | | | |
|---|---|---|---|
| 124,811 | 3/1872 | Green | 108/48 |
| 237,166 | 2/1881 | Burdge | 312/314 |
| 880,185 | 2/1908 | Beverly | 312/314 |
| 1,431,211 | 10/1922 | Bourke | 296/22 |
| 2,662,720 | 12/1953 | Patton | 108/48 |
| 2,810,617 | 10/1957 | Slanhoff | 312/314 |
| 2,897,030 | 7/1959 | Ficarella | 312/314 |
| 3,333,766 | 9/1967 | Crossland et al. | 312/258 |
| 3,809,425 | 5/1974 | Blaschke | 296/22 |
| 3,859,931 | 1/1975 | Lalonde | 108/44 |
| 3,915,529 | 10/1975 | Bernier | 312/324 |
| 3,934,924 | 1/1976 | Diliberti | 108/44 |
| 4,129,213 | 12/1978 | Fleig | 206/523 |
| 4,155,609 | 5/1979 | Skafte et al. | 312/314 |
| 4,310,207 | 1/1982 | Adams, Jr. | 312/314 |
| 4,313,385 | 2/1982 | Fitzgerald | 108/48 |

FOREIGN PATENT DOCUMENTS

| | | | |
|---|---|---|---|
| 934881 | 8/1963 | United Kingdom | 108/48 |

*Primary Examiner*—William E. Lyddane
*Assistant Examiner*—Thomas A. Rendos

[57] ABSTRACT

A kitchen table, for use with a motor vehicle camper, which is collapsible as a storage unit to carry cooking utensils. The table comprises a pair of panels which face each other to form a closed unit. The panels are hinged to open outwardly with one edge of the unit engagable with a wall hanger and an extensible leg to support the unit in a horizontal position. When the unit is opened one panel acts as a table and the other panel acts as a backboard carrying the utensils.

9 Claims, 3 Drawing Figures

KITCHEN TABLE FOR CAMPER

FIELD OF THE INVENTION

This invention relates to a kitchen table, collapsible as a storage unit, for use with a motor vehicle camper such as a trailer or a van.

BACKGROUND OF THE INVENTION

When camping with a trailer or a van it is desirable in good weather to prepare meals outdoors. Where there are no picnic tables available it is usual to set up a collapsible table, such as a card table, stowed in the camper or van, on which a stove and cooking utensils are rested. It is, of course, time consuming and inconvenient to gather all the materials together for this purpose and to return them to their places in the camper or van after use.

It is an object of the present invention to provide a kitchen table which is collapsible as a storage unit for cooking utensils and the like, and which is easily set up for use with the utensils being at hand.

SUMMARY OF THE INVENTION

Essentially the invention consists of a kitchen table collapsible as a storage unit, comprising: a unit having a pair of spaced panels with opposed inside surfaces when the unit is closed, outside surfaces, side edges and end edges, the panels being interconnected by hinge means at one side edge thereof for opening and closing the unit; means on one of the panels adjacent said hinged side edge thereof for engagement with support means on a wall; at least one leg hingedly connected to the outside surface of a first of said panels remote from said hinged side edge and pivotably movable to a position normal thereto to support said first panel in a horizontal position as a table when also supported on said wall; bracing means interconnecting said first panel and the second of said panels to support said second panel in a vertical position as a backboard when the unit is open; and means on the inside surface of said second panel for attaching cooking utensils thereto.

BRIEF DESCRIPTION OF THE DRAWINGS

An example embodiment of the invention is shown in the accompanying drawings in which.

DESCRIPTION OF PREFERRED EMBODIMENT

Figure 1:
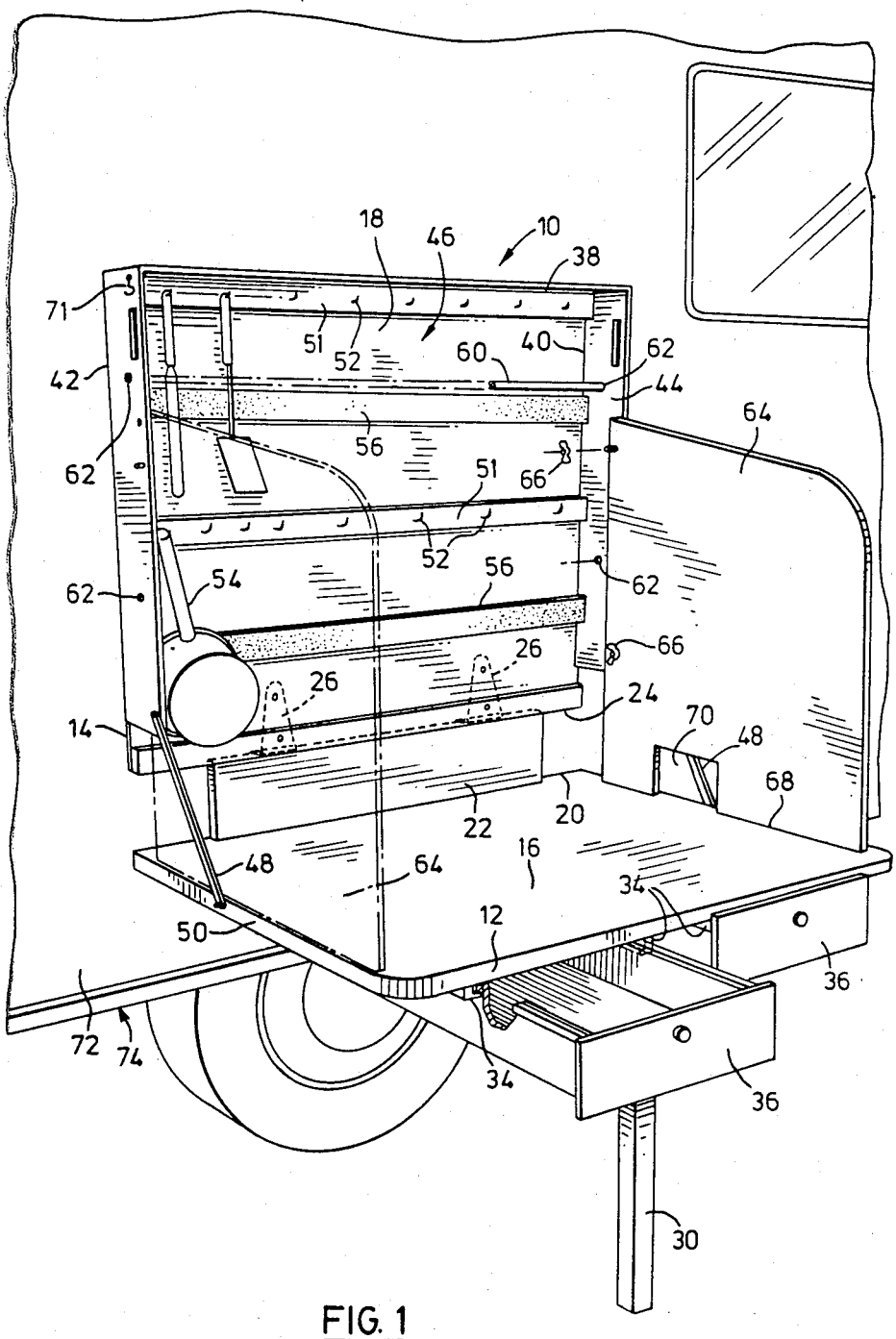
FIG. 1 is a perspective view of a table mounted and open for use.
Figure 2:
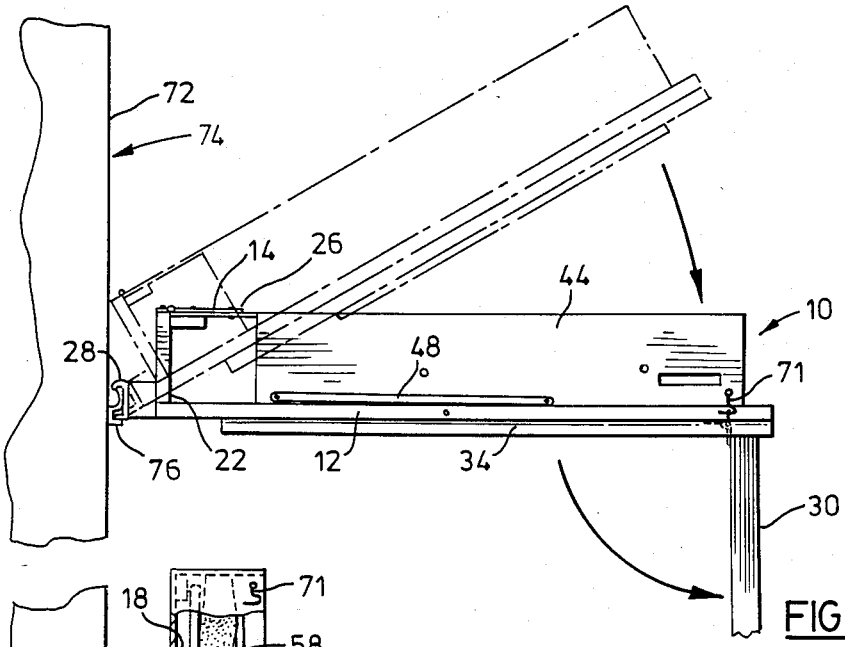
FIG. 2 is a side elevational view showing the table of FIG. 1 when closed; being mounted.

The example embodiment shown in the drawings consists of a unit 10 having a first rectangular panel 12 and a second rectangular panel 14 with spaced, opposed inside surfaces 16 and 18 respectively when the unit is closed as seen in FIG. 2.

One side edge 20 of first panel 12 carries an upright flange 22 which is interconnected with one side edge 24 of second panel 14 by a pair of hinges 26. At least one runner hook member 28 is also mounted along side edge 20 of first panel 12. A leg 30 is hinged to the outside surface 32 of first panel 12 remote from side edge 24, the leg being movable from a folded position parallel to the first panel into an open position normal to the first panel. Pairs of parallel rails 34 are mounted on outside surface 32 of first panel 12 to receive drawers 36.

Side edge 38 of second panel 14 remote from side edge 24 together with end edges 40 and 42 of the second panel carry a peripheral wall 44 which defines a well 46 and also spaces panels 12 and 14 apart when unit 10 is closed. A pair of brace members 48 interconnect end edges 50 of first panel 12 with wall 44 of second panel 14, the brace members being releasable for folding the two panels together to close the unit.

Figure 3:
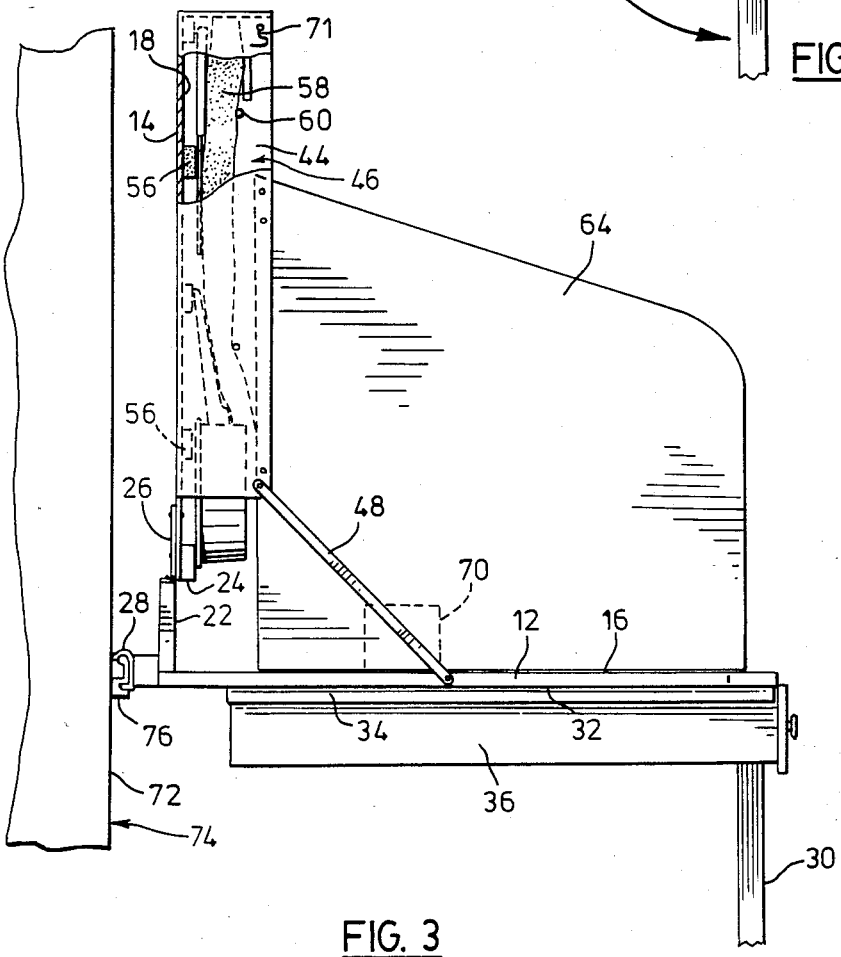
FIG. 3 is a view similar to FIG. 2 showing the mounted table fully opened and with attached baffles.

Inside surface 18 of second panel 14 carries a plurality of spaced slats 51 parallel to side edges 24 and 38 and the slats each carry a row of spaced hooks 52 for hanging utensils 54 when the second panel is in an open position. Strips 56 of resilient material against which utensils 54 may bear, are located between slats 51. As seen in FIG. 3, a pad 58 may be positioned in well 46 and secured by a plurality of parallel rods 60 anchored in apertures 62 in peripheral wall 44 to hold utensils 54 in place against second panel 14 when unit 10 is closed.

A pair of baffles 64 may be removably secured to unit 10, when it is opened for use, by wing nuts 66 to peripheral wall 44 of second panel 14 with the bottom edges 68 of the baffles resting on first panel 12. One of baffles 64 may have an aperture 70 for the hose connection of a propane stove resting on first panel 12. Unit 10 may be secured in its closed position by a latch 71.

In the operation of the device, unit 10 is brought to a wall 72, such as the side of a camper trailer 74, to which is fixed a horizontal hook rail 76. As seen in FIG. 2, closed unit 10 is attached to hook rail 76 by means of runner hook members 28 which are mounted on first panel 12. Leg 30 is then swung downwardly to support first panel 12, together with rail 76, in a horizontal position. Next, as seen in FIG. 3, second panel 14 is raised to a vertical position by pivoting it about hinges 26 and the second panel is secured in the vertical position by braces 48. The removal of pad 58 from well 46, by removing rods 60, gives access to utensils 54 which have been arranged in the well. Drawers 36 and baffles 64 may be mounted on opened unit 10 as desired. To close unit 10 the procedure is reversed.

If it is desired to leave unit 10 in its opened position a suitable cover (not shown) of plastic or other flexible material may be draped over the unit when not in use.

I claim:

1. A kitchen table collapsible as a storage unit, for use with a motor vehicle camper having an upright wall, comprising:

a unit having a pair of spaced panels with opposed inside surfaces when the unit is closed, outside surfaces, side edges and end edges, the panels being interconnected by hinge means at one side edge thereof for opening and closing the unit;

readily detachable means on a first of said panels adjacent said hinged side edge thereof for detachable engagement with support means on said wall;

at least one leg hingedly connected to the outside surface of said first of said panels remote from said hinged side edge and pivotably movable to a position normal thereto to support said first panel in a horizontal position as a table when also supported on said wall;

bracing means interconnecting said first panel and the second of said panels to support said second panel in a vertical position as a backboard when the unit is open; and means on the inside surface of said second panel for attaching cooking utensils thereto.

2. A table as claimed in claim 1 including a pair of planar baffles, one baffle being attachable vertically to one of said panels adjacent each end edge thereof when opened.

3. A table as claimed in claim 1 including at least one drawer slidably attachable to said first panel on the outside surface thereof.

4. A table as claimed in claim 1 in which the support engagement means is attached to the hinged side edge of said first panel.

5. A table as claimed in claim 1 including a flange on said first panel on the hinged side edge thereof, the hinge means interconnecting the flange and said second panel, and peripheral wall means on at least one of the panels spacing said panels apart when the unit is closed.

6. A table as claimed in claim 5 in which the support engagement means is attached to the hinged side edge of said first panel.

7. A table as claimed in claim 6 in which said support engagement means outstands from said flange and comprises hook means engagable with said wall support means.

8. A table as claimed in claim 5 in which the peripheral wall means includes a wall on said second panel on the end edges thereof and on that side edge opposite the hinged side edge thereof.

9. A table as claimed in claim 8 in which the means for attaching utensils to the inside surface of said second panel comprises rows of spaced hooks, and including a resilient sheet insertable into the well defined by the walls to retain utensils in attached position when the unit is closed.

* * * * *